US010612322B2

(12) United States Patent
Doyon

(10) Patent No.: US 10,612,322 B2
(45) Date of Patent: Apr. 7, 2020

(54) ROD HANDLING SYSTEM

(71) Applicant: Usinage Marcotte Inc., Val-d'Or (CA)

(72) Inventor: Martin Doyon, Val-d'Or (CA)

(73) Assignee: Usinage Marcotte Inc., Val-D'Or, Qc (CA)

( * ) Notice: Subject to any disclaimer, the term of this patent is extended or adjusted under 35 U.S.C. 154(b) by 0 days.

(21) Appl. No.: 16/095,388

(22) PCT Filed: Apr. 24, 2017

(86) PCT No.: PCT/CA2017/000094

§ 371 (c)(1),
(2) Date: Oct. 22, 2018

(87) PCT Pub. No.: WO2017/185164

PCT Pub. Date: Nov. 2, 2017

(65) Prior Publication Data

US 2019/0128078 A1 May 2, 2019

Related U.S. Application Data

(60) Provisional application No. 62/326,936, filed on Apr. 25, 2016.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/20; E21B 19/146; E21B 19/16
(Continued)

(56) References Cited

U.S. PATENT DOCUMENTS 4,604,724 A * 8/1986 Shaginian ..... E21B 19/20 166/53
5,458,454 A * 10/1995 Sorokan ..... E21B 19/155 166/77.52

(Continued)

OTHER PUBLICATIONS

WO PCT/CA2017/000094—ISR, dated Nov. 2017.
WO PCT/CA2017/000094—WO, dated Nov. 2017.

*Primary Examiner* — Lynn E Schwenning
(74) *Attorney, Agent, or Firm* — Agence de Brevets Fournier

(57) ABSTRACT

A rod handling system for a drilling activity includes i) a rod support defining a first axis, ii) a rod dispensing device positioned adjacent to the rod support for moving a rod between a first lateral side of the rod dispensing device and the rod support, and iii) a rod positioning device that is positioned adjacent to the rod dispensing arm on a second lateral side thereof for moving the rod between a first position, on the rod support, and a second position on a lateral side of the rod positioning device that is opposite the rod dispensing device in a generally vertical orientation. The system has a first advantage of dedicating a different device for each of the two main tasks necessary in order to complete a cycle of inserting or removing drill rods from a drill head. Furthermore, it has a second advantage of reducing the time required to complete an inserting/removing cycle because the whole cycle is performed by two independent devices that can be simultaneously operated.

18 Claims, 11 Drawing Sheets

(58) Field of Classification Search
USPC ..... 414/22.51–22.71
See application file for complete search history.

(56) References Cited

U.S. PATENT DOCUMENTS

| | | | | |
|---|---|---|---|---|
| 6,634,443 | B1 * | 10/2003 | Paech | E21B 15/04 175/85 |
| 6,926,488 | B1 * | 8/2005 | Bolding | E21B 19/15 211/70.4 |
| 7,802,636 | B2 * | 9/2010 | Childers | E21B 19/20 175/52 |
| 8,186,925 | B2 | 5/2012 | Littlely | |
| 8,186,926 | B2 | 5/2012 | Littlely | |
| 8,240,968 | B2 | 8/2012 | Hopkins et al. | |
| 8,291,791 | B2 | 10/2012 | Light et al. | |
| 8,910,719 | B2 | 12/2014 | Kockeis et al. | |
| 2003/0159854 | A1 * | 8/2003 | Simpson | E21B 15/003 175/52 |
| 2006/0151215 | A1 * | 7/2006 | Skogerbo | E21B 19/155 175/52 |
| 2013/0195583 | A1 * | 8/2013 | Rodgers | E21B 19/15 414/22.62 |
| 2013/0309044 | A1 * | 11/2013 | Adams | E21B 19/14 414/22.51 |
| 2013/0341013 | A1 * | 12/2013 | Flusche | E21B 7/02 166/250.15 |
| 2015/0136420 | A1 * | 5/2015 | Tengliden | E21B 19/16 166/379 |
| 2016/0017673 | A1 * | 1/2016 | Roodenburg | E21B 19/155 414/22.62 |
| 2016/0130891 | A1 * | 5/2016 | Wase | E21B 19/161 166/77.51 |

* cited by examiner

ROD HANDLING SYSTEM

FOREIGN PRIORITY CLAIM

This is a 35 U.S.C. § 371 application of, and claims priority to, International Application No. PCT/CA2017/000094, which was filed on Apr. 24, 2017, and published as Publication No. WO 2017/185164A1, which claims priority to US Provisional Patent Application No. U.S. 62/326,936, which was filed on Apr. 25, 2016, the entirety of all the applications are incorporated herein by reference.

FIELD

The present disclosure relates to drilling activities such as in the mining and construction fields. More specifically, the present disclosure concerns a rod handling system for such activities.

BACKGROUND

Before a site is chosen to be exploited for its underground resources, exploration works must be done in order to accurately define what quantity of ore is contained in the rock and where it is located. The same exploration works are performed on a mine site once it is operational. Amongst all the exploration activities done, drilling the rock to get samples represents an essential activity. This can be achieved by different model of drill rigs, each involving rods that can be assembled together by the means of male to female thread connections at their ends and that are inserted one after the other behind the perforation tool.

The same principle of driving a perforation tool down into the ground by the means of threaded rods can be found in many other fields other than mining exploration. For example, the petroleum field uses drill rigs to sample the ground in search for oil reserve or to reach them; the civil engineering field uses drill rigs to sample the ground before building structures; water well works are done with drill rigs; and, service holes in underground mines also use drill rigs.

The most common way of inserting and withdrawing the rods are by means of a worker who handles them in and out of the drill unit. The operations carried by that person are very demanding physically and are the cause of many injuries in the field. For example, due to the heavy weight of the rods and their long shape, many accidents happen when the operator becomes exhausted and trips or pinches one of its limbs. Another danger related to the manipulation of the rods is that it exposes the operator to hydraulically moving mechanisms such as the rotation head, the chuck and the mast of the drill.

With the evolution of technologies, tools to improve the speed of inserting rods one after the other into a drill head or removing them from the drill head have been developed. Those tools are commonly known as rod handlers. Current rod handlers found on the market imply whether that the rods are stacked vertically on a support attached to the drill rig or that an operator participates in moving the rods in order to lay them horizontally on the ground out of the work area. Such an intervention from the operator includes lifting the whole rods or supporting one end of the rod in order to slide it into place while the other end is held and moved by a hydraulic mechanism.

Drawbacks of current rod handling tools and methods includes the risk that the operator could pinch any of his limbs or hurt himself if the rod handler makes a move that the operator would not expect. Also, stacking rods vertically can be very dangerous when working with high velocity winds or when the ground under the drill rig isn't leveled or firm enough. In those cases, the rod stack could eventually break its support due to unaccounted forces induced to its structure and then fall down or turn the whole drill rig over because of a cantilever effect.

Rod handlers are known involving horizontal stacking, but they are required to be placed in the longitudinal axis of a drill rig to grab the rods in front of the mast and drop them in line with the mast. In some cases, that requires the layout of a much longer working surface than what is allowed to setup the drill rig on and can lead to the cancellation of the drilling works or to the use of more dangerous equipment.

SUMMARY

According to an illustrative embodiment, there is provided rod handling system comprising:

a rod support defining a first axis;

a rod dispensing device positioned adjacent to the rod support for moving a rod between a first lateral side of the rod dispensing device and the rod support; and a rod positioning device that is positioned adjacent to the rod dispensing arm on a second lateral side thereof for moving the rod between a first position, on the rod support, and a second position on a lateral side of the rod positioning device that is opposite the rod dispensing device in a generally vertical orientation.

As will become more apparent upon reading the following description, an embodiment of a device for handling rods improves the inserting/removing processes' efficiency by allowing handling longer and heavier strings of rods than a worker, hence reducing the duration of the operations. It also has the advantage of being able to be set up beside a drill rig instead of behind it, making the site development more simple and realizable than if it required more lengthwise space.

Other advantages of an embodiment of a device for handling rods include improved safety considering that no worker is required to handle rods. Also, false maneuvers are prevented by the complete automatization of the rod handling.

Other objects, advantages and features of the rod handling system will become more apparent upon reading the following non-restrictive description of preferred embodiments thereof, given by way of example only with reference to the accompanying drawings.

DETAILED DESCRIPTION

Figure 1:
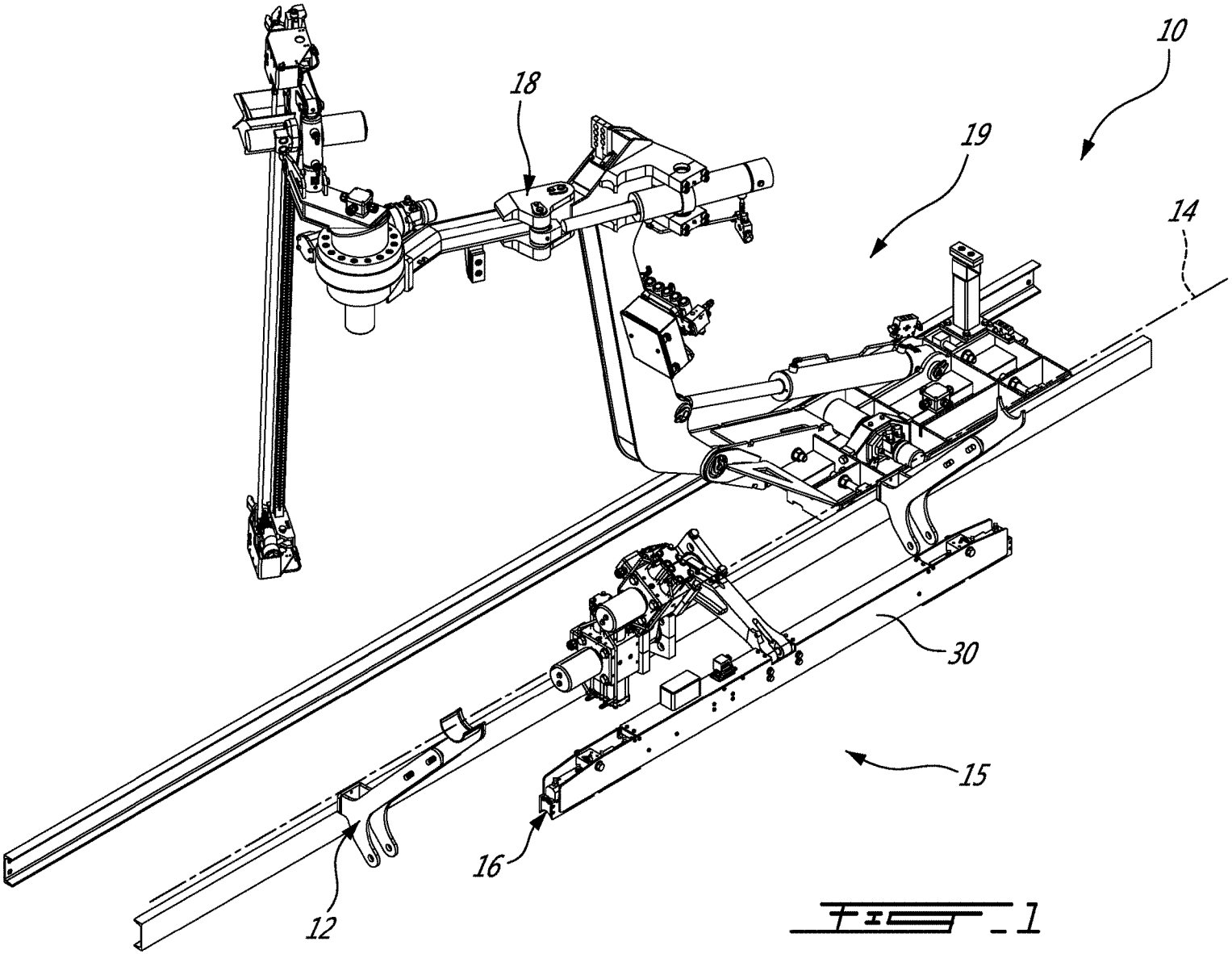
FIG. 1 is a partial perspective view of a rod handling system according to a first illustrated embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

A rod handling system 10 according to an illustrated embodiment will be described with reference first to FIG. 1. It is noted that the system 10 is illustrated without some of its frame elements and connectors to alleviate the view.

The rod handling system 10 comprises a rod support 12 defining a first horizontal axis 14, a rod dispensing device 16 positioned adjacent to the rod support 12 for moving a rod 13' from a stack 21 of rods 13 (see for example in FIG. 4) between a first lateral side 15 of the dispensing device 16 and the rod support 12; and a rod positioning device 18 that is positioned adjacent to the rod dispensing device 16 on a second lateral side 19 thereof.

The rod support 12, rod dispensing device 16 and rod positioning device 18 are all secured to a support frame (not shown) which can be placed beside a drill rig or integrated to a drill rig's structure (both not shown) in order to manipulate drill rods 13 in place of a worker. Such manipulation includes either inserting drill rods 13 into a drill head 17 or removing them from the drill head 17 and moving rods 13 in and out of a stack 21 of rods 13.

Figure 2:
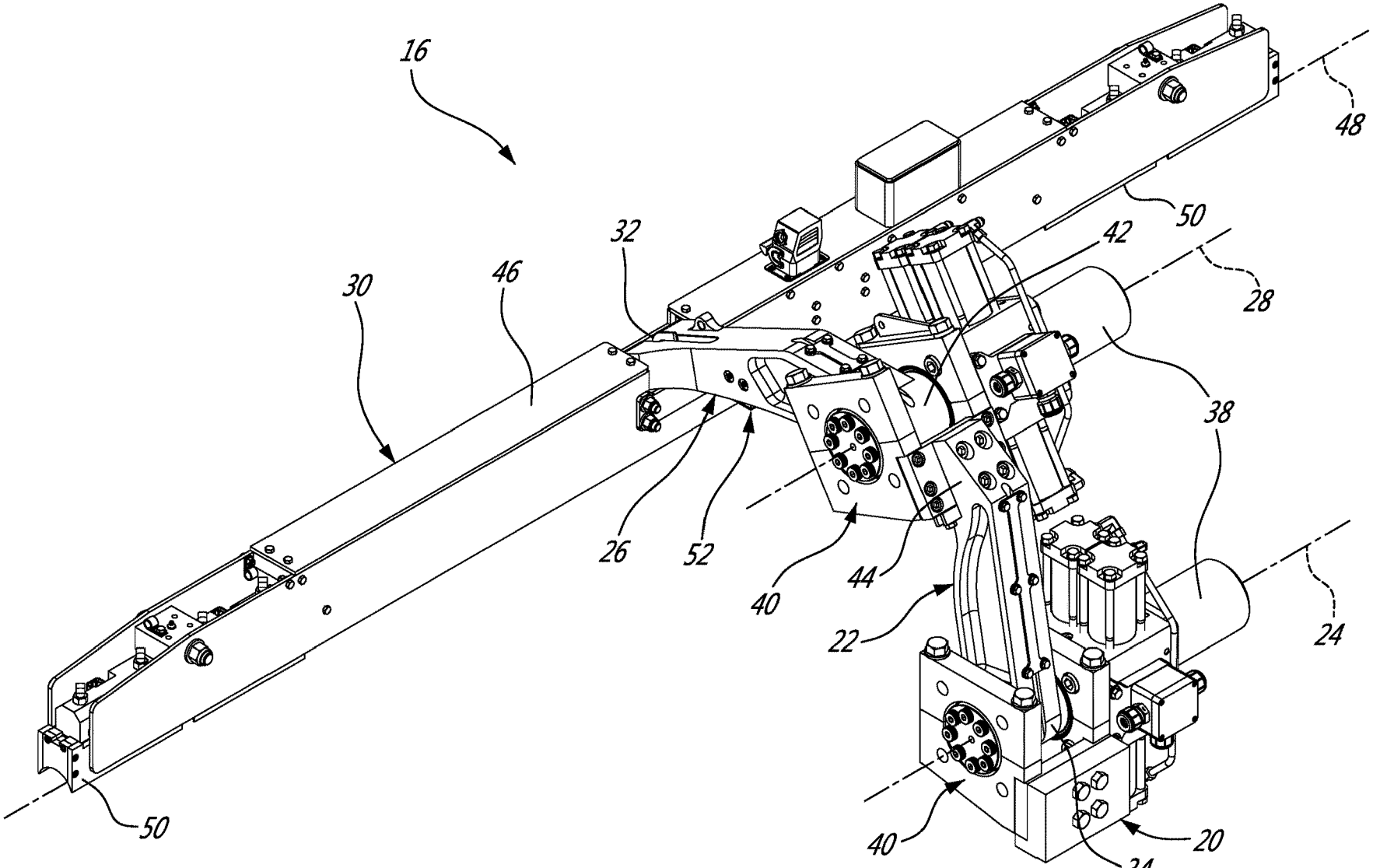
FIG. 2 is an isolated view of the rod dispensing device from the rod handling system of FIG. 1.

With reference to FIG. 2, the rod dispensing device 16 is in the form of an articulated arm comprising a base 20 that is secured to the support frame, a first rigid member 22 that is mounted to the base 20 for pivotal movement about a second axis 24 relative to the base 20, a second rigid member 26 that is mounted to the first rigid member 22 for relative pivotal movement about a third axis 28, and a rod grabber 30 that is mounted to the second rigid member 26 at the distal end 32 thereof so as to freely pivot about an axis parallel the second axis 24.

More specifically, the proximate end 34 of the first rigid member 22 is secured to the output (not shown) of a first rotary actuator 38. The first rotary actuator 38 is fixedly mounted to the base 20 via a mounting bracket 40. Similarly, the proximate end 42 of the second rigid member 26 is secured to the output (not shown) of a second rotary actuator 38 which, in turn, is fixedly mounted to the distal end 44 of the first rigid member 26 via a mounting bracket 40.

The grabber 30 includes an elongated member 46 that extends along a fourth axis 48 and two grabbing elements 50, each one mounted to the member 46 at a respective lateral end for free rotational movement. It is to be noted that the second, third and fourth axes 24, 28 and 48 are all parallel to the axis 14.

The grabbing elements 50 are in the form of electromagnets that are shaped for complementary lateral abutment of a rod 13-13'.

The rod positioning device 16 further comprises a laser sensor 52 for scanning the stack of rods 21.

Each actuator 38 is equipped with an encoder (not shown). The actuators 38, encoders and sensor 52 are all connected to a microcontroller (not shown) that commands the movement of the dispensing device 16 and more generally the sequence of operations of the overall system 10.

Figure 4:
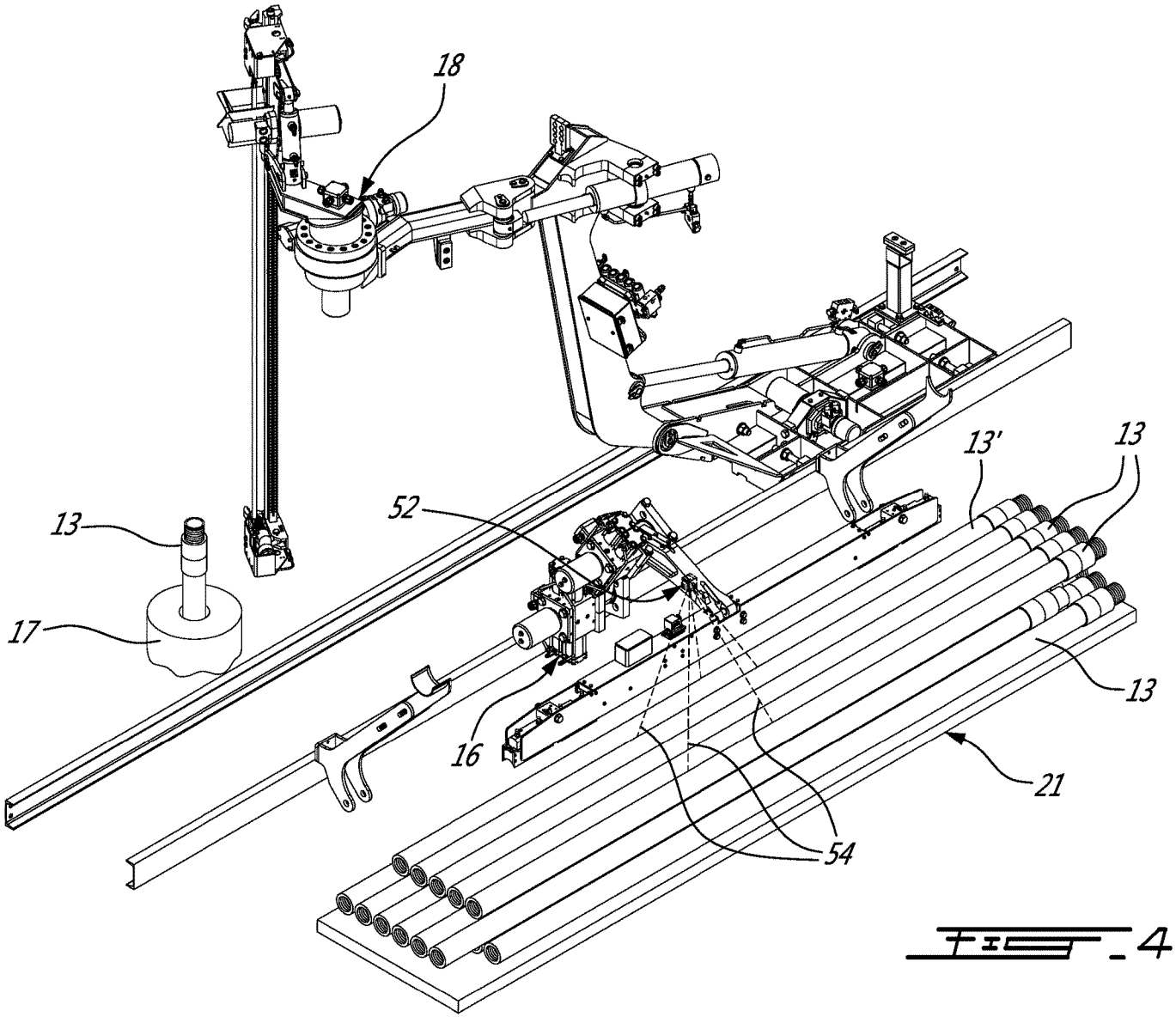
FIGS. 4 to 11 are perspective views similar to FIG. 1, illustrating operational steps of the rod handling system; the system being shown adjacent to a pile of rods and an already installed rod.
Figure 5:
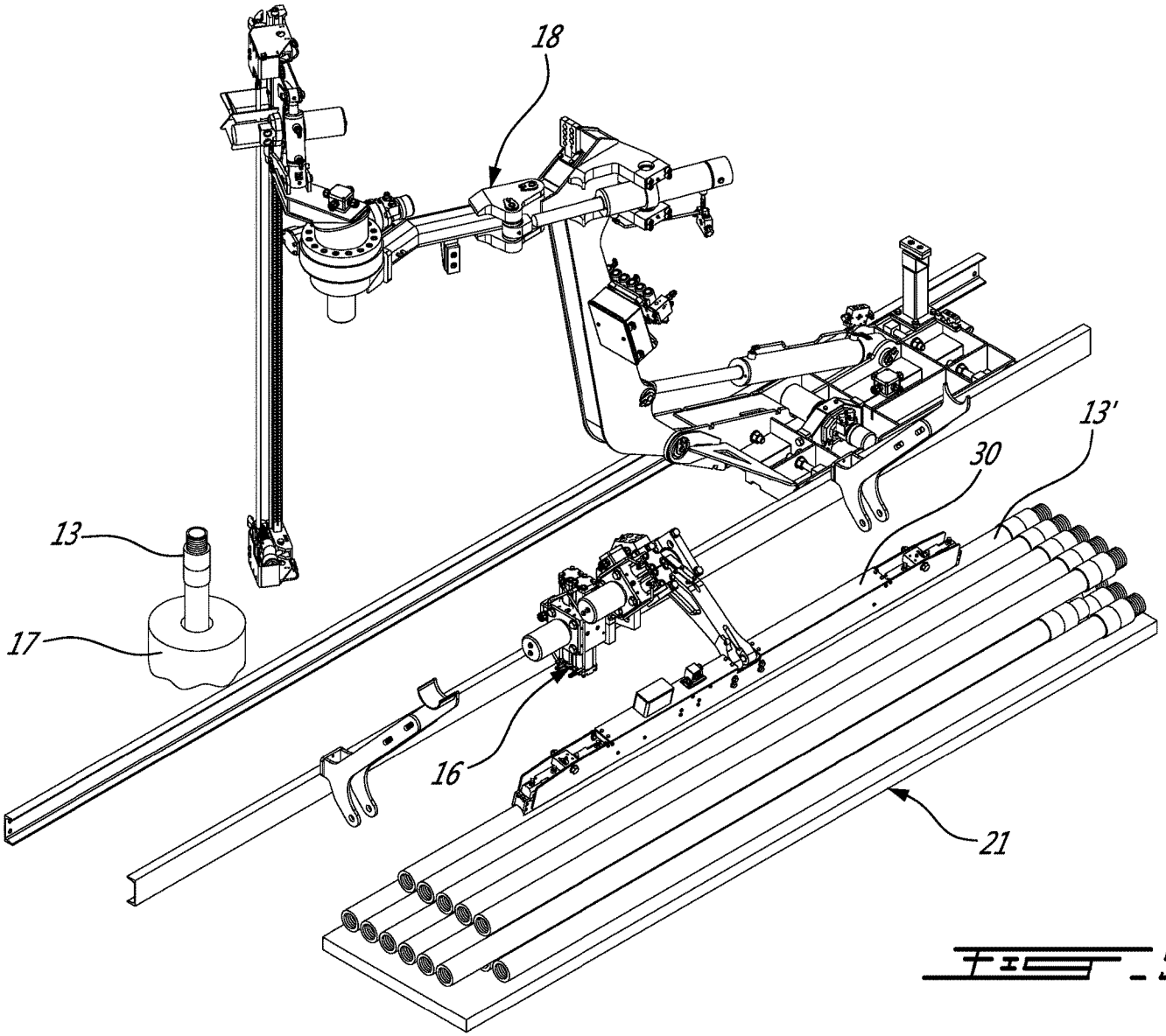
Figure 6:
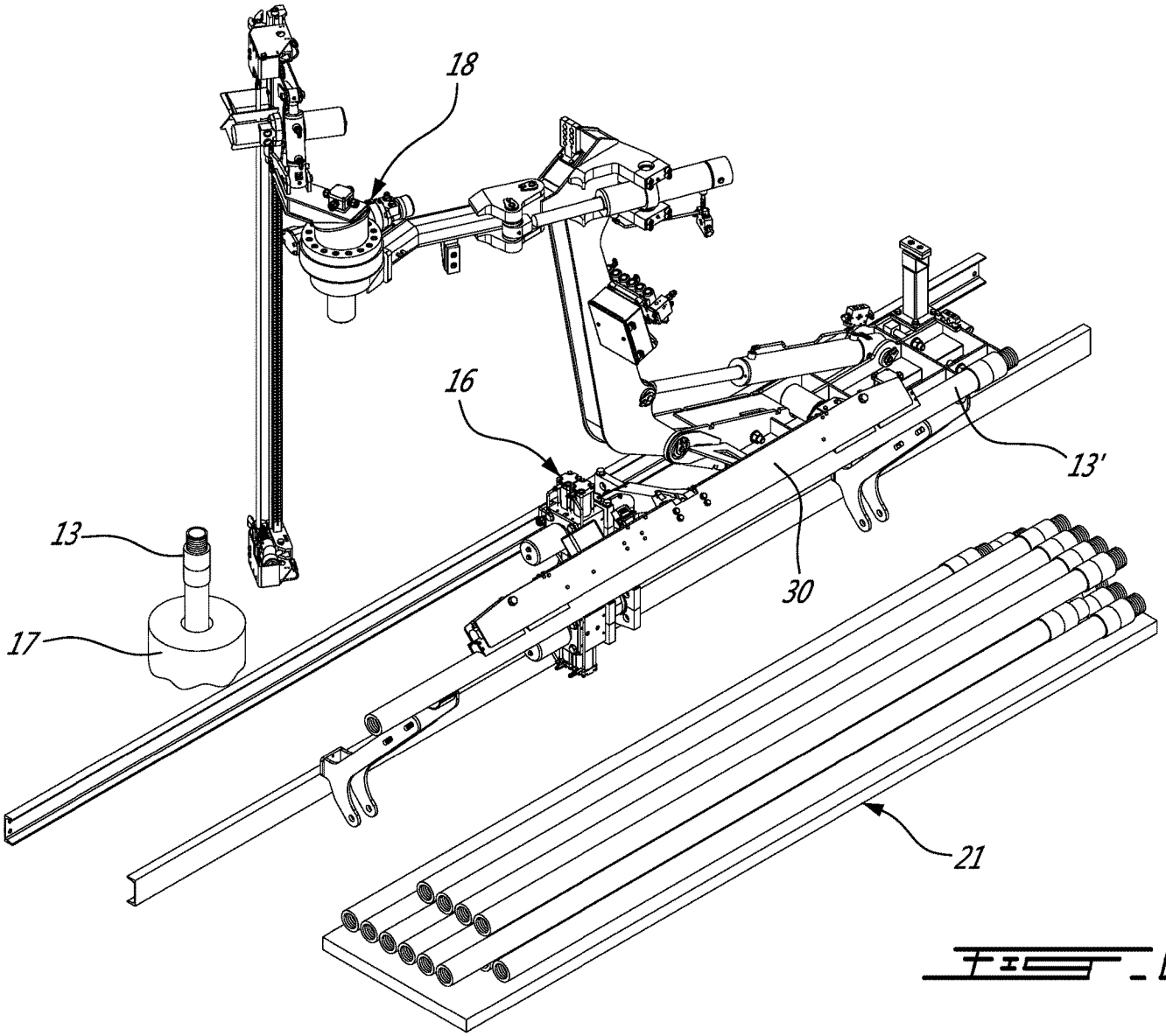

With references to FIGS. 4 to 6, the operation of the rod dispensing device 16 will now be described.

The first step is the scanning by the laser sensor 52 of the stack of rods 21 (see lines 54 on FIG. 4) to determine the rod 13' therein that is the highest and within reach. Other criteria can also be used. The rigid members 22 and 26 are then precisely actuated to correctly positioned the grabber 30 adjacent to the rod 13' that have been selected by the microcontroller using the result of the scan from the sensor 52 and the predetermined criteria. The grabbing elements 50 are then actuated to grab the selected rod 13' (see FIG. 5). The grabber 30 is so moved that the rod 13' is positioned in the rod support 12. The rod 13' is then released by the grabber 30 and is then ready to be picked up by the rod positioning device 18 to begin a rod inserting cycle. The above described operation of the rod dispensing device 16 is reversed when a removed rod is to be put back in the stack 21. Obviously, the scan can be omitted in such a case.

Since actuators, encoders and sensors are all believed to be well-known in the art, they will not be described herein in more detail for concision purposes.

It is to be noted that many modifications could be made to the rod dispensing device 16 described hereinabove and illustrated in the appended drawings. For example:

- the number and shape of the electromagnets 50 on the grabber 30 may be different than illustrated;
- the rod grabber 30 can be mounted to the second rigid member 26 so as to pivot about an axis parallel the second axis 24 in a manner controlled by an actuator (not shown);
- the device 16 may include more or less rigid members than two (2);
- the rotary actuator can be replaced by linear actuators such as cylinders (not shown);
- the grabbing elements 50 can be replaced by hooks (not shown) to be inserted in the openings at each longitudinal ends of a rod 13 or by another grabbing element;
- the device 16 may be configured with further or alternative movement capabilities;
- the operational steps of the device 16 may be different or in different order than illustrated.

Figure 3:
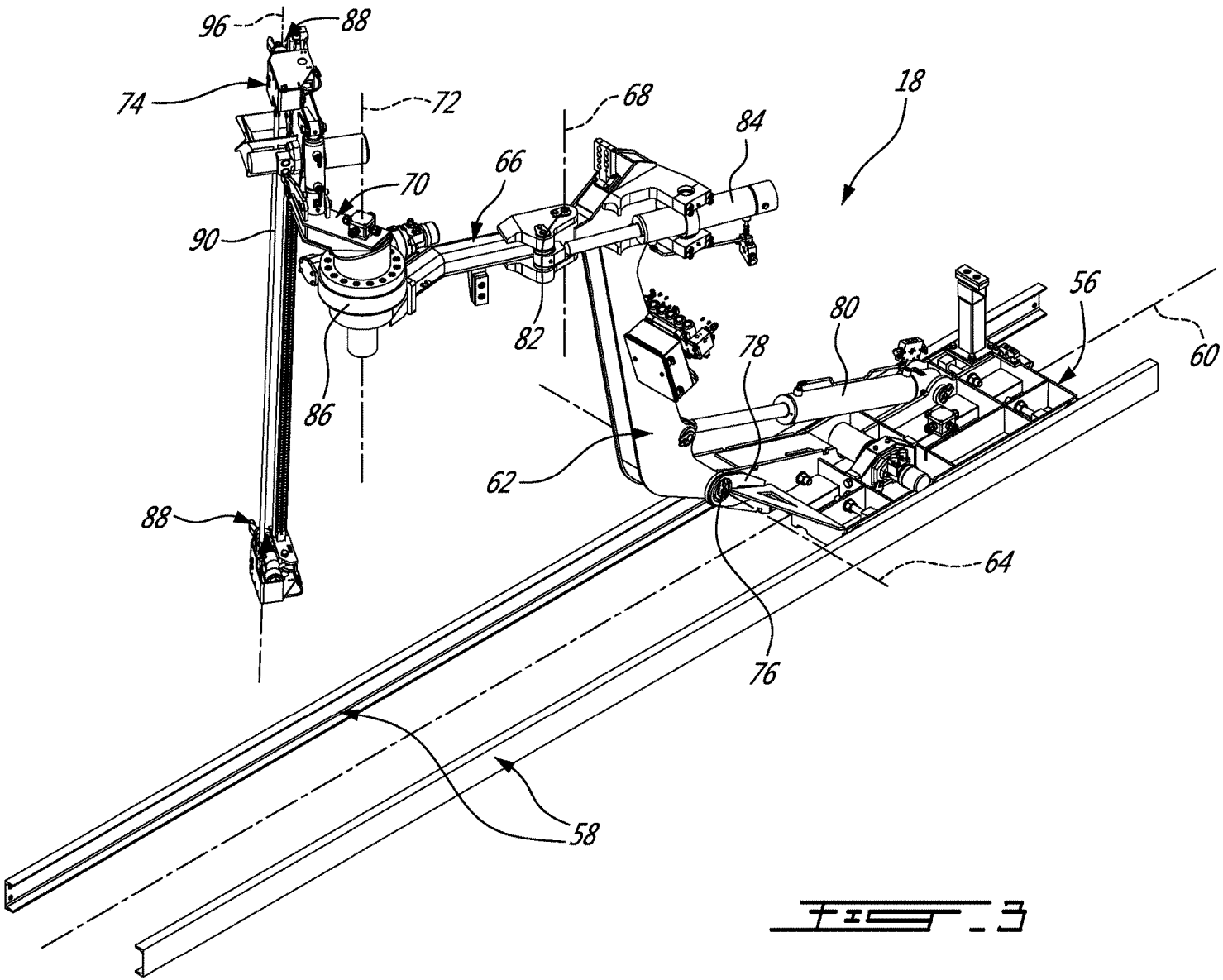
FIG. 3 is an isolated perspective view of the rod positioning device from the rod handling system of FIG. 1.

Turning now to FIG. 3, the rod positioning device 18 will be described in more detail.

Figure 10:
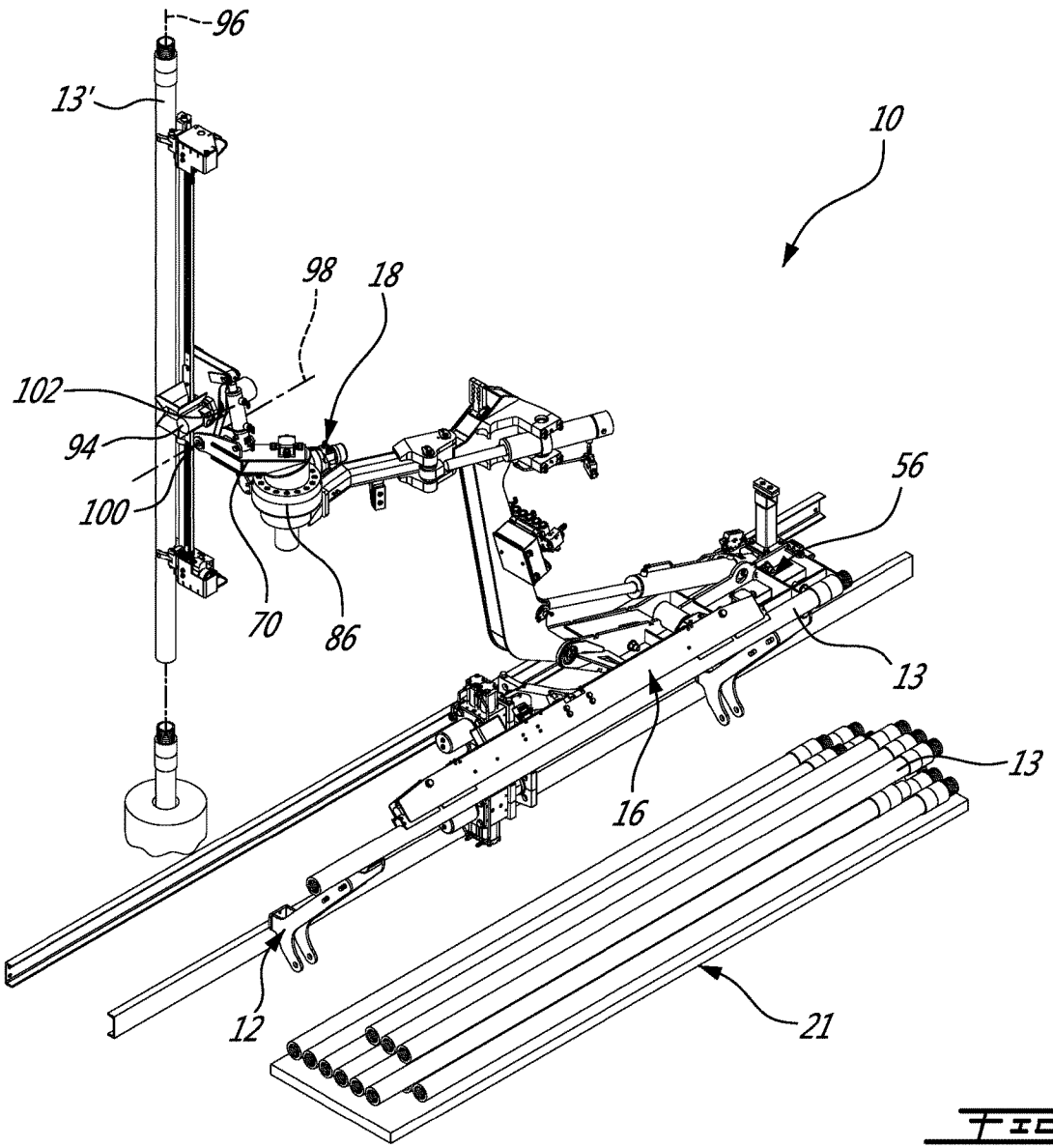

The rod positioning device 18 is in the form of an articulated arm comprising i) a motorized trolley 56 slidably mounted on rails 58 via rollers (not shown) for movement along a fifth axis 60 parallel to the rails 58 and to the first axis 14, ii) a first rigid member 62 mounted to the trolley 56 for pivotal movement about a sixth axis 64 perpendicular to the fifth axis 60, iii) a second rigid member 66 mounted to the first rigid member 62 for pivotal movement about a seventh axis 68 that is perpendicular to the sixth axis 64, iii) a third rigid member 70 that is mounted to the second rigid member 66 for pivotal movement about a seventh axis 72 that is parallel to the sixth axis, and iv) a gripper 74 that is mounted to the third member 70 for pivotal movement about the axis 98 (see on FIG. 10).

More specifically, the motorized trolley 56 includes a motor (not shown) and an encoder (not shown) that is coupled to both the motor and the microcontroller for controlled movement of the trolley 56.

The first rigid member 62 is mounted to the trolley 56 via a pivot pin 76 secured in a U-shaped portion 78 of the trolley 56. An actuator, in the form of a first cylinder 80, is pivotably mounted to both the trolley 56 and the first rigid member 62 therebetween. A linear encoder (not shown) is coupled to the cylinder 80 and to the microcontroller for the controlled actuation of the pivotal movement of the member 62 about the axis 64.

The second rigid member 66 is mounted to the first rigid member 62 via a pivot pin 82 which is fixedly mounted to the second rigid member 62. An actuator, in the form of a second cylinder 84, is pivotably mounted to both the first rigid member 62 and the second rigid member 66 therebetween. A linear encoder (not shown) is coupled to the cylinder 84 and to the microcontroller for the controlled actuation of the pivotal movement of the member 66 about the axis 68.

The third rigid member 70 is mounted to the second rigid member 66 via a rotary actuator 86 which is fixedly mounted to the second rigid member 66, the third rigid member 70 being mounted to the output of the actuator 86. A rotary encoder (not shown) is coupled to the rotary actuator 86 and to the microcontroller for the controlled actuation of the pivotal movement of the member 70 about the axis 72. The gripper 74 comprises two motorized clamp mechanisms 88 that are operatively mounted to an elongated rod 90 at both longitudinal ends thereof.

Figure 7:
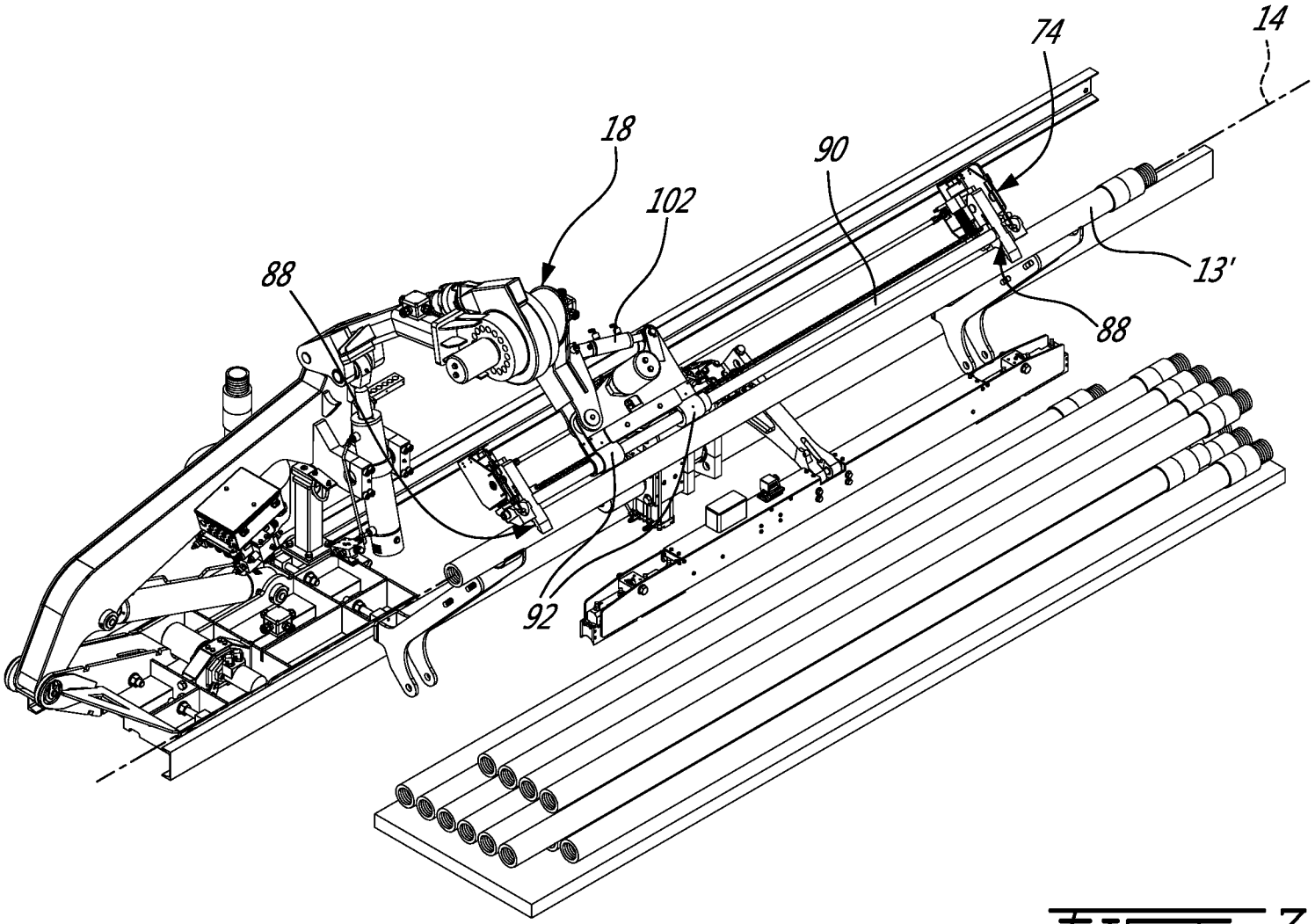
Figure 8:
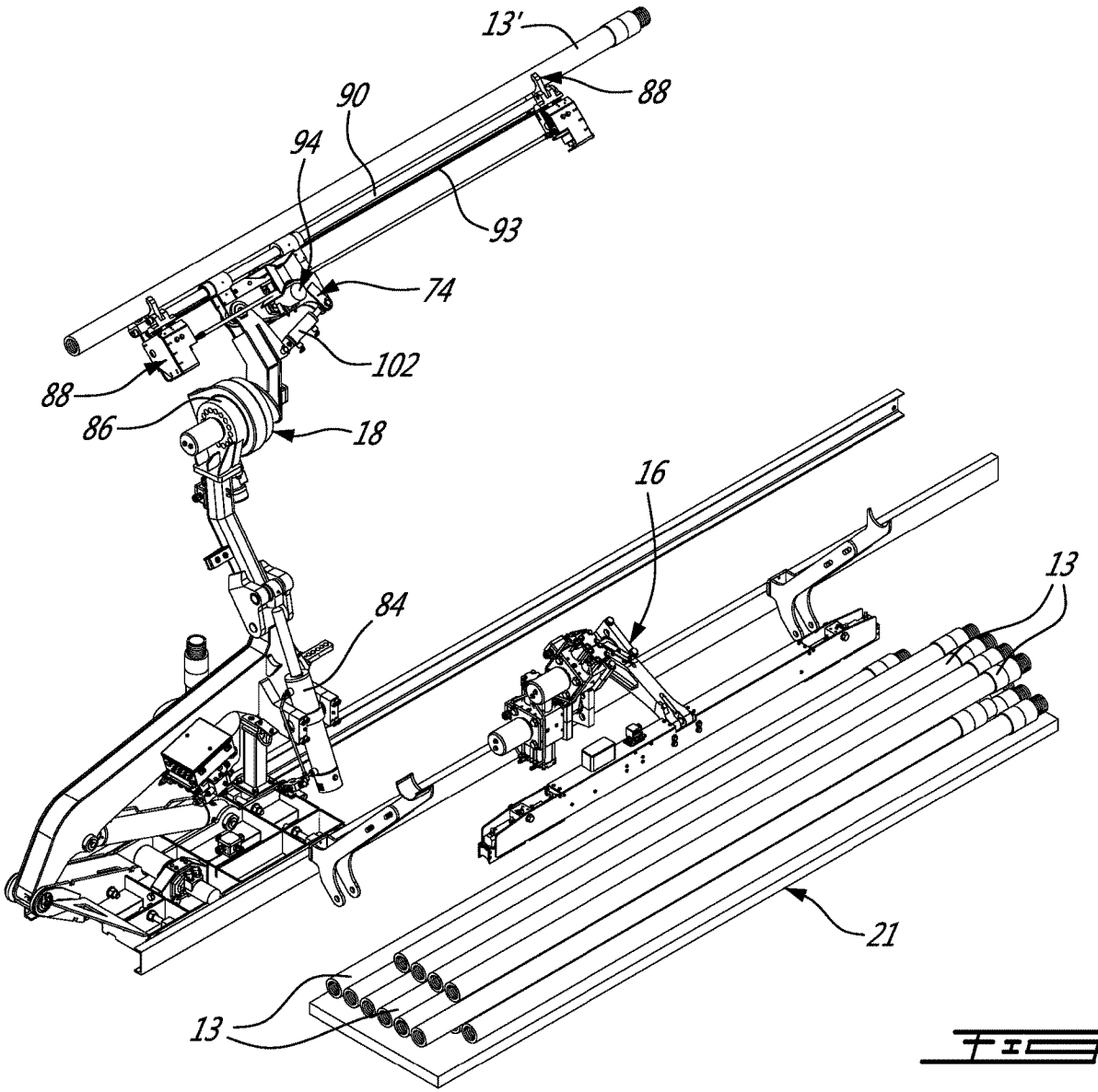
Figure 9:
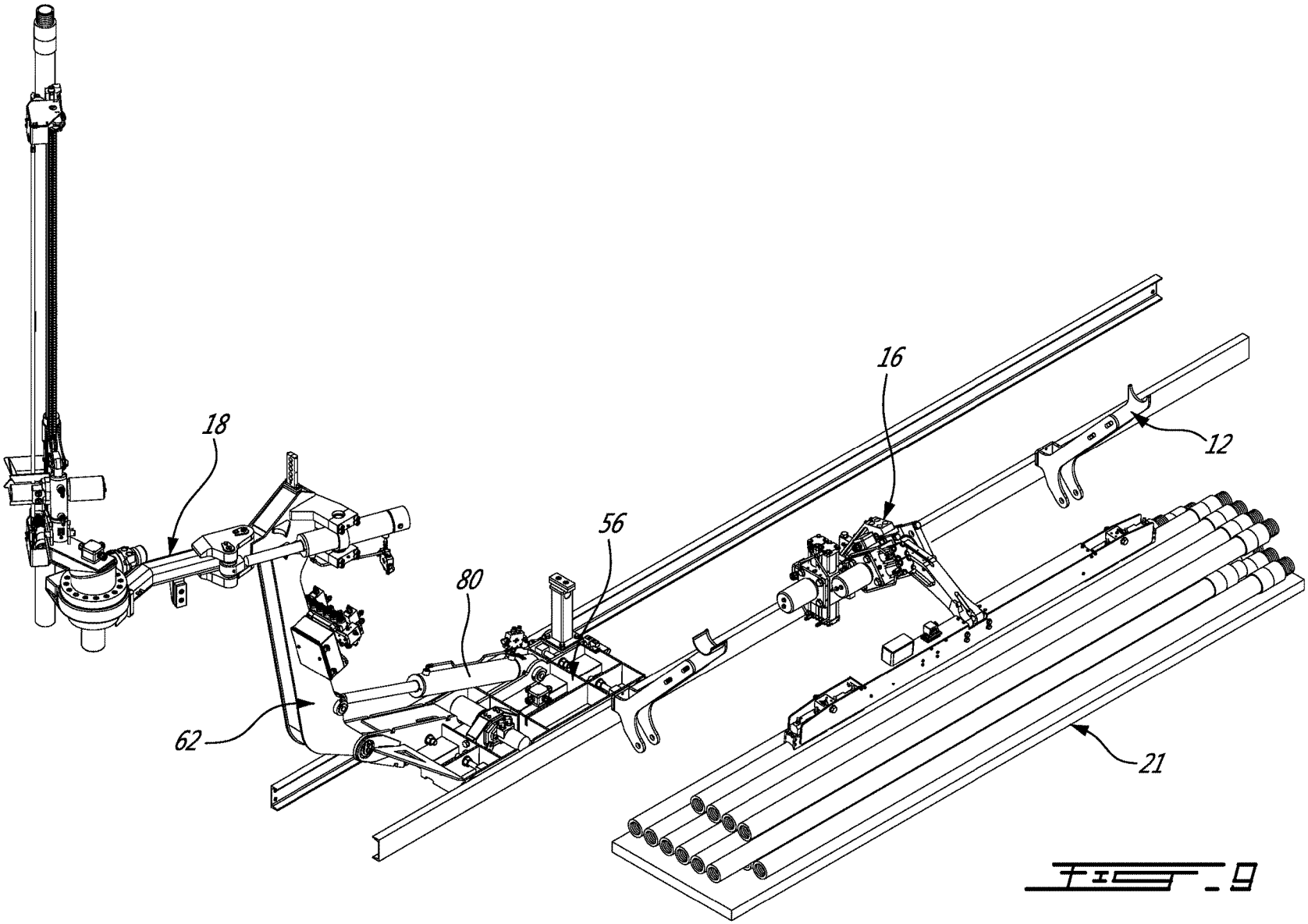

Turning now briefly to FIGS. 7 and 8, the rod 90 is slidably mounted in two tubes 92 which are fixedly mounted to the gripper 74. The clamps 88 are therefore slidable relative to the third rigid member 70. A chain 93 is attached to the rod 90 via both clamp mechanisms 88 so as to extend along the rod 90, parallel thereto. A drive mechanism 94 is mounted to both the rod 90 and the third rigid member 70 therebetween. The chain 93 is operatively coupled to the drive mechanism 94 so that the chain 93, the rod 90 and both mechanisms 88, are slidably movable relative to the drive mechanism 94 and therefore to the third rigid member 70.

A rotary encoder (not shown) is coupled to the drive mechanism 94 and to the microcontroller for the controlled sliding of the rod 90 relative to the third rigid member 70 along an eight axis 96 defined by the position of a rod 13' that is grabbed by the gripper 74.

With reference now to FIGS. 8 and 10, the drive mechanism 94 is further mounted to the third rigid member 70 for pivotal movement about a ninth axis 98 via a pivot pin 100 secured to the third rigid member 70. A small cylinder 102, which is pivotably mounted to both the third rigid member 70 at one end and to the drive mechanism 94 at the other, is used to tilt the gripper 74 along its longitudinal direction relative to the third rigid member 70.

With references to FIGS. 7 to 11, the operation of the rod positioning device 18 will now be described.

Since the operation of the rod dispensing device 16 has already been described hereinabove in the detail, it will not be further described in parallel to the operation of the rod positioning device 18. However, as can be seen in FIGS. 7 to 11 and as discussed hereinabove, both devices 16 and 18 operate independently in parallel. Obviously, their operations are synchronized so that a single rod or a rod string (including a plurality of rods screwed together) is positioned on the rod support 12 at any given time.

With reference to FIG. 7, the rod positioning device 18 is operated so that the rod gripper 74 is positioned adjacent to the rod 13' in the rod support 12 with axes 14 and 96 superimposed. The motorized clamp mechanisms 88 are then energized so as to close onto the rod 13' in the support 12.

Referring to FIG. 8, the actuators 84 and 86 are then moved so as to lift the rod 13' out of the support 12, which is then ready to receive another one of the rods 13 from the stack 21 therein. As can be seen in this Figure, the rod dispensing device 16 is already in position to pick a new rod 13 in the stack 21.

The small cylinder 102 is actuated to correct any parallelism error between the rod 13' and the drill head 17.

The cylinder 80 extends to pivot the first rigid member 62 (see FIG. 9) in front of the trolley 56. The trolley 56 and the rotary actuator 86 are then operated to move the third rigid member 70 so that the axis 96 and therefor the rod 13' are aligned with the drill head 17 thereabove.

Figure 11:
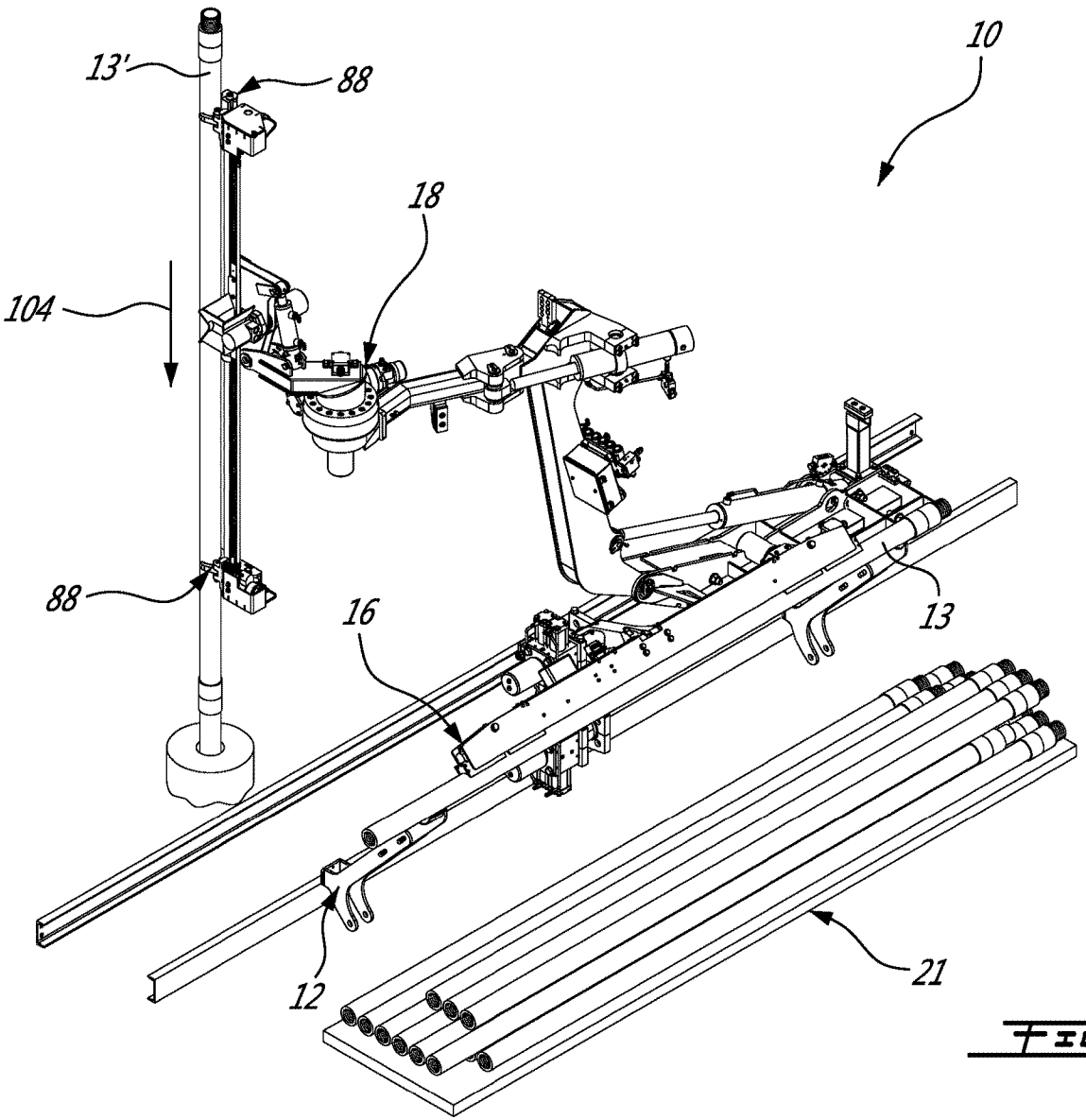

With reference to FIG. 11, while the rod 13' is still held by the clamps 88, the drive mechanism 94 is actuated to move the rod 13' onto concentric contact with the drill head 17 (see arrow 104).

Once in position, the rod 13' is screwed by an automatic device (not shown) either mounted to the rod gripper 74, to another component of the rod handling device 10, to the drill head 17 or else. A human operator can also be used with, however, the inherent risk described hereinabove.

The above-described operation of the rod positioning device 18 is reversed when a rod is removed from the drill head 17.

It is to be noted that many modifications could be made to the rod positioning 18 device described hereinabove and illustrated in the appended drawings. For example:

- the device 18 may include more or less rigid members than three (3);
- the rotary actuator can be replaced by cylinders between two adjacent members and vice versa;
- the rod gripper 74 can be replaced by another functionally equivalent device or mechanism;
- the device 18 may be configured with further or alternative movement capabilities;
- the operational steps of the device 18 may be different or in different order than illustrated.

The microcontroller is in the form of any device or plurality of devices coupled to the rod handling system 10, that is configured to control the operation thereof, including without limitation sending actuation signal to the various actuators of the system 10 and receiving and analyzing signals from the various sensors thereof.

It is to be noted that the use of the different terms 'gripping' and 'grabbing' are not intendent herein and in the claims to establish structural differences but rather to distinguish functional differences.

The configuration of the system for handling rods according to the illustrated embodiment has a first advantage of dedicating a device for each of the two main tasks necessary in order to complete a cycle of inserting or removing drill rods from a drill head. Furthermore, it has a second advantage of reducing the time required to complete an inserting/removing cycle because the whole cycle is performed by two independent devices that can be simultaneously operated.

Although a rod handling system has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A rod handling system comprising:

a rod support defining a first axis;

a rod dispensing device positioned adjacent to the rod support for moving a rod between a first lateral side of the rod dispensing device and the rod support; and a rod positioning device that is positioned adjacent to the rod dispensing device on a second lateral side thereof for moving the rod between a first position, on the rod support, and a second position on a lateral side of the rod positioning device that is opposite the rod dispensing device in a generally vertical orientation;

wherein the rod positioning device is slidably mounted on rails; the rod support, and the rod dispensing device being fixedly mounted to the rails.

2. A rod handling system as recited in claim 1, wherein at least one of the rod dispensing and positioning devices includes an articulated arm.

3. A rod handling system as recited in claim 1, wherein the rod dispensing device includes an articulated arm and a rod grabber attached to the articulated arm at the distal end thereof.

4. A rod handling system as recited in claim 1, wherein the rod dispensing device further includes a sensor adapted to scan a stack of rods.

5. A rod handling system as recited in claim 1, wherein the rod positioning device includes an articulated arm and a rod gripper attached to the articulated arm at the distal end thereof.

6. A rod handling system as recited in claim 1, wherein the rod dispensing and positioning devices are operatively independent of one another.

7. A rod handling system as recited in claim 1, wherein the first axis is horizontal or near horizontal.

8. A rod handling system as recited in claim 1, wherein the rod is horizontal when the rod is at the first lateral side of the rod dispensing device.

9. A rod handling system, comprising:

a rod support defining a first axis;

a rod dispensing device positioned adjacent to the rod support for moving a rod between a first lateral side of the rod dispensing device and the rod support; and a rod positioning device that is positioned adjacent to the rod dispensing arm device on a second lateral side thereof for moving the rod between a first position, on the rod support, and a second position on a lateral side of the rod positioning device that is opposite the rod dispensing device in a generally vertical orientation;

wherein the rod dispensing device includes an articulated arm and a rod grabber attached to the articulated arm at the distal end thereof;

wherein the articulated arm includes a base, a first rigid member mounted to the base for pivotal movement about a second axis generally parallel to the first axis and a second rigid member mounted to the first rigid member at a distal end thereof for relative pivotal movement about a third axis generally parallel to the first axis; the rod grabber being mounted to the second rigid member at a distal end thereof.

10. A rod handling system, comprising:

a rod support defining a first axis;

a rod dispensing device positioned adjacent to the rod support for moving a rod between a first lateral side of the rod dispensing device and the rod support; and a rod positioning device that is positioned adjacent to the rod dispensing arm device on a second lateral side thereof for moving the rod between a first position, on the rod support, and a second position on a lateral side of the rod positioning device that is opposite the rod dispensing device in a generally vertical orientation;

wherein the rod dispensing device includes an articulated arm and a rod grabber attached to the articulated arm at the distal end thereof;

wherein the rod grabber includes an elongated body extending along a second axis generally parallel to the first axis and at least one rod grabbing element mounted to the elongated body.

11. A rod handling system as recited in claim 10, wherein the at least one grabbing element includes an electromagnet.

12. A rod handling system, comprising:

a rod support defining a first axis;

a rod dispensing device positioned adjacent to the rod support for moving a rod between a first lateral side of the rod dispensing device and the rod support; and a rod positioning device that is positioned adjacent to the rod dispensing arm device on a second lateral side thereof for moving the rod between a first position, on the rod support, and a second position on a lateral side of the rod positioning device that is opposite the rod dispensing device in a generally vertical orientation;

wherein the rod positioning device includes an articulated arm and a rod gripper attached to the articulated arm at the distal end thereof;

wherein the articulated arm is mounted onto a motorized trolley for movement along a second axis generally parallel to the first axis.

13. A rod handling as recited in claim 12, wherein the articulated arm includes i) a first rigid member mounted to the trolley for relative pivotal movement about a third axis generally perpendicular to the second axis, ii) a second rigid member mounted to the first rigid member for relative pivotal movement about a fourth axis that is perpendicular to both the third and second axis, and iii) a third rigid member mounted to the second rigid member for relative pivotal movement about a fifth axis that is parallel to the fourth axis; the rod gripper being mounted to the third rigid member.

14. A rod handling system as recited in claim 13, wherein the rod gripper is mounted to the third rigid member for pivotal movement about a sixth axis that is generally perpendicular to the fifth axis.

15. A rod handling system as recited in claim 13, wherein the rod gripper includes an elongated body having at least one motorized clamp mounted thereto for selectively and releasably gripping the rod; the elongated body being mounted to the third rigid member for relative sliding movement along a sixth axis that is generally parallel to the fifth axis.

16. A rod handling system as recited in claim 15, wherein the at least one motorized clamp includes two motorized clamps, one at each longitudinal ends of the elongated body.

17. A rod handling system comprising, a rod support defining a first axis;

a rod dispensing device positioned adjacent to the rod support for moving a rod between a first lateral side of the rod dispensing device and the rod support; and a rod positioning device that is positioned adjacent to the rod dispensing arm device on a second lateral side thereof for moving the rod between a first position, on the rod support, and a second position on a lateral side of the rod positioning device that is opposite the rod dispensing device in a generally vertical orientation;

wherein the rod positioning device includes an articulated arm and a rod gripper attached to the articulated arm at the distal end thereof;

wherein the rod gripper includes an elongated body having at least one motorized clamp mounted thereto for selectively and releasably gripping the rod; the elongated body being mounted to the third rigid member for relative sliding movement along a second axis.

18. A rod handling system as recited in claim 17, wherein the at least one motorized clamp includes two motorized clamps, one at each longitudinal ends of the elongated body.

* * * * *